US007182156B2

(12) United States Patent
Charland et al.

(10) Patent No.: US 7,182,156 B2
(45) Date of Patent: Feb. 27, 2007

(54) SYSTEM FOR OVERBURDEN DRILLING

(76) Inventors: Luc Charland, 1553, O'Reilly Street, Sherbrooke, Quebec (CA) J1J 1C2; Roger Charland, 1553, O'Reilly Street, Sherbrooke, Quebec (CA) J1J 1C2

( * ) Notice: Subject to any disclaimer, the term of this patent is extended or adjusted under 35 U.S.C. 154(b) by 119 days.

(21) Appl. No.: 10/459,465

(22) Filed: Jun. 12, 2003

(65) Prior Publication Data

US 2004/0251054 A1 Dec. 16, 2004

(51) Int. Cl.
*E21B 10/64* (2006.01)

(52) U.S. Cl. ..... 175/257; 175/171; 175/385; 175/386

(58) Field of Classification Search ..... 175/171, 175/257, 385, 386, 389
See application file for complete search history.

(56) References Cited

U.S. PATENT DOCUMENTS

| | | | | |
|---|---|---|---|---|
| 3,870,114 | A | 3/1975 | Pulk et al. | |
| 4,765,416 | A | 8/1988 | Bjerking et al. | |
| 5,025,875 | A * | 6/1991 | Witt | 175/393 |
| 5,435,401 | A | 7/1995 | Hedlund et al. | |
| 5,542,483 | A | 8/1996 | Edman | |
| 5,590,726 | A | 1/1997 | Jarvela et al. | |
| 5,839,519 | A | 11/1998 | Spedale, Jr. | |
| 5,921,332 | A | 7/1999 | Spedale, Jr. | |
| 5,934,394 | A | 8/1999 | Fareham | |
| 5,957,224 | A | 9/1999 | Ilomaki | |
| 6,021,856 | A | 2/2000 | Pascale | |
| 6,035,953 | A * | 3/2000 | Rear | 175/171 |
| 6,102,141 | A | 8/2000 | Engstrom et al. | |
| 6,106,200 | A * | 8/2000 | Mocivnik et al. | 405/259.5 |
| 6,112,835 | A | 9/2000 | Grafe et al. | |
| 6,182,776 | B1 | 2/2001 | Asberg | |
| 6,702,040 | B1 * | 3/2004 | Sensenig | 175/23 |

FOREIGN PATENT DOCUMENTS

| | | |
|---|---|---|
| EP | 0 358 786 A1 | 3/1990 |
| WO | WO 200281856 A1 * | 10/2002 |

OTHER PUBLICATIONS

Concentrix Overburden Drilling System.
Outils de forage Sandvik Coromant TUBEX.
Centrex.
Stratex Drill Systems.
Symmetrix For drilling of tube umbrella.

* cited by examiner

*Primary Examiner*—David Bagnell
*Assistant Examiner*—Giovanna M Collins

(57) ABSTRACT

The present invention provides a global drilling system comprising a crown bit, a driver drill bit and a square drill bit. The crown bit has a tubular body with an inner surface and an outer surface, wherein the inner surface circumscribes a hollow passageway, and a pair of projections extending into said hollow passageway. The pair of projections are positioned substantially opposite one another on said inner surface. The driver drill bit has a drilling head with a pair of cut-away portions positioned substantially opposite one another and a pair of locking surfaces adapted for engaging the projections on the crown bit. The square drill bit has a drilling head with two tapered cut-away portions positioned substantially opposite one another. Each cut-away portion corresponds to one of the pair of projections such that the drilling head is able to pass through the hollow passageway of the crown bit.

28 Claims, 17 Drawing Sheets

SYSTEM FOR OVERBURDEN DRILLING

FIELD OF THE INVENTION

The present invention relates to a global system for overburden drilling, and more specifically, the present invention relates to a crown bit, a driver drill bit and a square drill bit for an overburden drilling system.

BACKGROUND OF THE INVENTION

Full-face overburden drilling systems that use a crown bit and a driver drill bit are well known in the art. These two parts are typically used in the first step of a two step drilling procedure, wherein the first step involves drilling through the overburden material, which may include earth, sand, clay, gravel and boulders for example, in order to reach harder ground material commonly referred to as bedrock. The second step involves sub-casing drilling through the bedrock with a conventional drilling method.

In existing full-face overburden drilling systems, in order to accomplish the first step, the driver drill bit and the crown bit are releasably connected in a locking engagement and rotate together in order to drill through the overburden material. The crown bit, which defines a hollow passageway for receiving the driver drill bit, is connected to the base of a casing. The crown bit can be connected to the casing with bolts, threads or weldings, for example. Therefore, in use, as the driver drill bit and the crown bit drill into the ground, the casing, which has been connected to the crown bit, is pulled into the hole with the crown bit. The casing acts to prevent the hole from collapsing in upon itself. Once the driver drill bit and the crown bit have passed through the majority of the overburden material, to the depth at which the bedrock begins, the driver drill bit is unlocked from the crown bit and pulled out of the hole through the casing. The casing and crown bit remain in the hole. A standard drill bit is then inserted into the hole through the casing and through the crown bit, at which point the standard drill bit is used for sub-case drilling in the bedrock.

Typically, in order to allow for the crown bit and the driver drill bit to be locked together during drilling, the two components are provided with a projection-recess assembly. More specifically, the crown bit includes at least three projections that extend into its hollow passageway and that are adapted to engage with mating recesses provided on the driver drill bit.

A deficiency with this type of arrangement is that the projections of the crown bit limit the size of the drill bit that can be used, since the drill bit must pass through the passageway of the crown bit. As such, the maximum diameter of the drill bit for sub-casing drilling is determined by the diameter of the portion of the hollow passageway of the crown bit that includes the projections. As such, the drill bits being used with existing full-faced overburden drilling systems are smaller in size than what could theoretically pass through the casing in the drilled hole.

In down the hole drilling, the drilling components, meaning the driver drill bit, and later on the drill bit for drilling through the bedrock, are connected to a hammer. It is the hammer that provides the drilling components with the necessary force and vibration to drill into the ground. When a smaller drill bit is used for drilling through the bedrock because the hollow passageway of the crown bit limits its size, a smaller hammer must be used. Unfortunately, a smaller hammer imparts less force and vibration to the hammer and therefore takes longer to do the same job as a larger drill bit that could use a larger hammer. As such, existing full-face overburden drilling systems are operating at a reduced efficiency.

Against this backdrop, it can be seen that there is a need in the industry for an overburden drilling system that alleviates, at least in part, the deficiencies associated with the prior art full-faced overburden drilling systems.

SUMMARY OF THE INVENTION

As embodied and broadly described herein, the present invention provides a crown bit suitable for use with a driver drill bit for overburden drilling. The crown bit comprises a tubular body having an inner surface and an outer surface. The inner surface circumscribes a hollow passageway for receiving the drill bit. The crown bit further comprises a pair of projections that extend into the hollow passageway for engaging the driver drill bit. The projections are positioned substantially opposite one another on the inner surface.

In accordance with a specific example of implementation, the crown bit comprises at most the two projections on its inner surface.

In accordance with a further specific example of implementation, the hollow passageway is characterized by a maximum diameter and a minimum diameter, wherein the pair of projections define therebetween the minimum diameter. The projections are positioned on the inner surface of the crown bit according to a specific configuration that maximizes the amount of contiguous inner surface area defining the maximum diameter of the hollow passageway.

As embodied and broadly described herein, the present invention further provides a driver drill bit suitable for use with a crown bit for overburden drilling. The driver drill bit comprises a drilling head having a drilling face and a peripheral surface. The peripheral surface has a substantially cylindrical shape with two cut-away portions positioned substantially opposite one another. The drilling head further has a pair of locking surfaces. Each locking surface extends from a respective cut-away portion of the drilling head, and is adapted for engaging a respective projection on the crown bit.

As embodied and broadly described herein, the present invention further provides a system suitable for overburden drilling. The overburden drilling system comprises a crown bit and a driver drill bit. The crown bit includes a tubular body having an inner surface and an outer surface. The inner surface circumscribing a hollow passageway. The crown bit further having a pair of projections extending into the hollow passageway. The projections are positioned substantially opposite one another on the inner surface. The driver drill bit includes a drilling head having a drilling face and a peripheral surface and a pair of cut-away portions positioned substantially opposite one another on the peripheral surface. Each cut-away portion is adapted to receive a corresponding one of the pair of projections for enabling the drilling head to pass through the hollow passageway.

As embodied and broadly described herein, the present invention further provides a system suitable for sub-casing drilling. The system comprises a crown bit and a square drill bit. The crown includes a tubular body having an inner surface and an outer surface. The inner surface circumscribes a hollow passageway. The system further comprises a pair of projections extending into the hollow passageway. The projections are positioned substantially opposite one another on the inner surface. The square drill bit has a drilling head adapted to pass all the way through the hollow passageway of the crown bit.

As embodied and broadly described herein, the present invention further provides a global drilling system comprising a crown bit, a driver drill bit and a square drill bit. The crown bit has a tubular body having an inner surface and an outer surface, and a pair of projections. The inner surface circumscribes a hollow passageway and the pair of projections extends into the hollow passageway. The projections are positioned substantially opposite one another on the inner surface. The driver drill bit has a drilling head having a drilling face and a peripheral surface. The peripheral surface includes a pair of cut-away portions positioned substantially opposite one another, and a pair of locking surfaces. Each locking surface extends from a respective cut-away portion of the drilling head. Each locking surface is adapted for engaging the projection of the crown bit. The square drill bit has a drilling head having a drilling face and a peripheral surface and two tapered cut-away portions positioned substantially opposite one another on the peripheral surface. Each cut-away portion corresponds to one of the pair of projections such that the drilling head is able to pass through the hollow passageway of the crown bit.

As further embodied and broadly described herein, the present invention provides an overburden drilling system that comprises a square drill bit having a maximum diameter of 6 inches and a minimum diameter of 5½ inches and a crown bit having a tubular body for receiving the square drill bit. The crown bit has an outer diameter of 7.5 inches and is suitable for receiving a casing having an outer diameter of 6⅝ inches and an inner diameter of 6 inches.

As still further embodied and broadly described herein, the present invention provides an overburden drilling system that comprises a square drill bit having a maximum diameter of 8 inches and a minimum diameter of 7½ inches and a crown bit having a tubular body for receiving the square drill bit. The crown bit has an outer diameter of 9.5 inches and is suitable for receiving a casing having an outer diameter of 8⅝ inches and an inner diameter of 8 inches.

BRIEF DESCRIPTION OF THE DRAWINGS

A detailed description of examples of implementation of the present invention is provided hereinbelow with reference to the following drawings, in which.

Figure 1B:
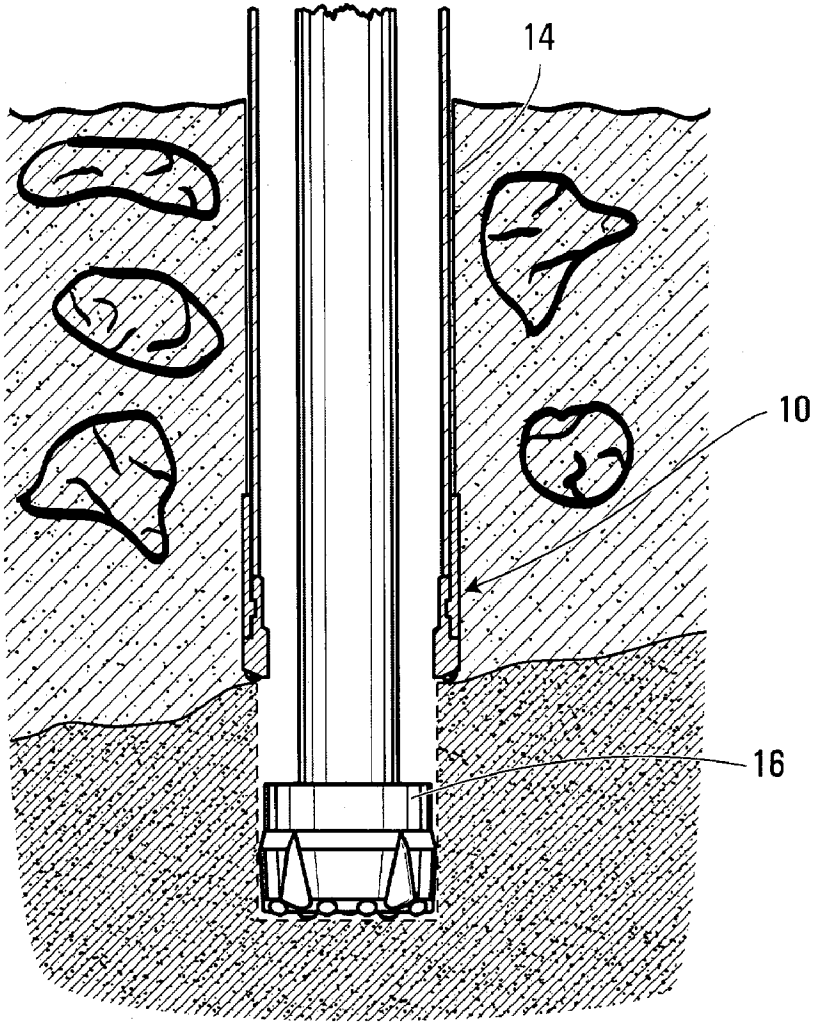
FIGS. 1*a* and 1*b* show two stages of a down-the-hole drilling process, in accordance with a specific example of implementation of the present invention.

In the drawings, embodiments of the invention are illustrated by way of example. It is to be expressly understood that the description and drawings are only for the purposes of illustration and as an aid to understanding, and are not intended to be a definition of the limits of the invention.

DETAILED DESCRIPTION

Figure 1A:
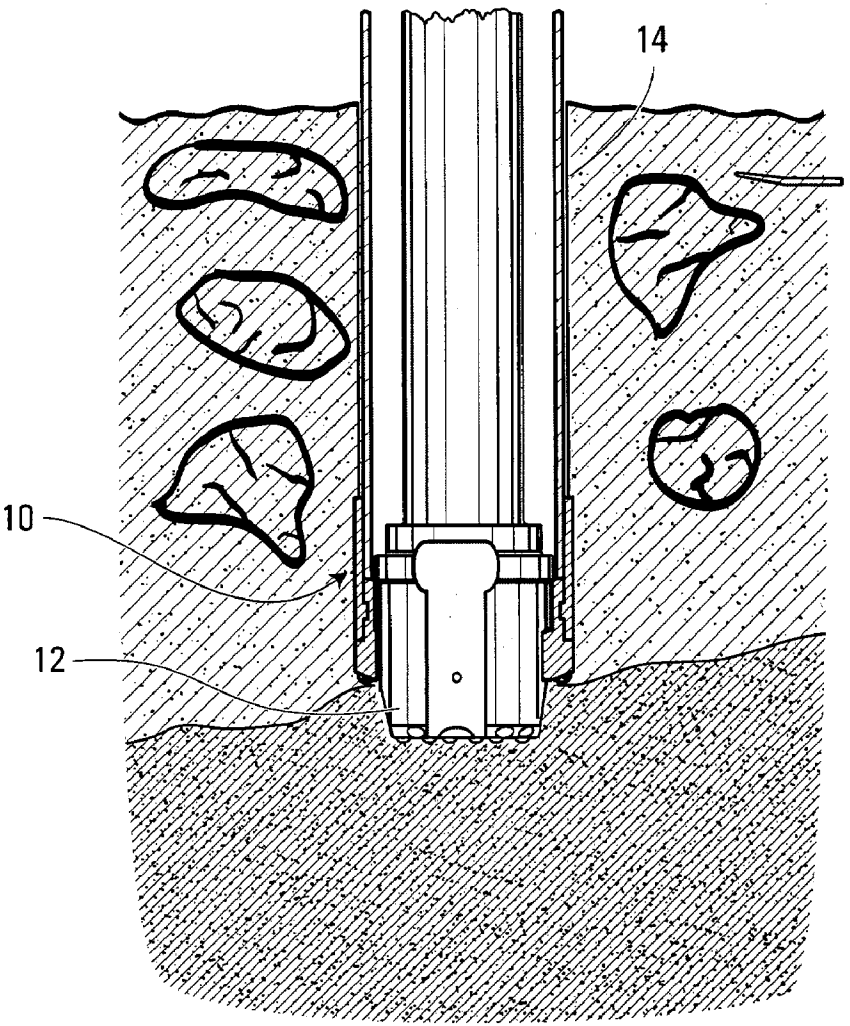

Shown in FIGS. 1*a* and 1*b* are representations of two steps of an overburden drilling process using a global drilling system in accordance with a specific example of implementation of the present invention. As shown, the global drilling system includes a crown bit 10, a driver drill bit 12 and a square drill bit 16.

FIG. 1*a* shows a representation of the first step of the drilling process, wherein the crown bit 10 and the driver drill bit 12 are connected together in order to drill a hole through overburden material, which may include, but is not limited to, earth, sand, clay, gravel and boulders. As will be described in more detail further on, the crown bit 10 is adapted to be releasably connected in locking engagement with the driver drill bit 12, and is adapted to be connected to a casing 14. As the driver drill bit 12 and the crown bit 10 drill the hole, the crown bit 10 pulls the casing 14 into the hole, such that the casing 14 lines the hole in order to prevent the hole from collapsing in upon itself.

FIG. 1*b* shows a representation of the second step of the drilling process, wherein the driver drill bit 12 has been disconnected from the crown bit 10 and pulled out of the hole, thereby leaving the crown bit 10 and the casing 14 within the hole. Once the driver drill bit 12 has been removed from the hole, the square drill bit 16 is inserted into the hole, through the casing 14 and through the crown bit 10. Once the square drill bit 16 has passed through the crown bit 10 it is able to continue drilling through the bedrock.

Figure 2:
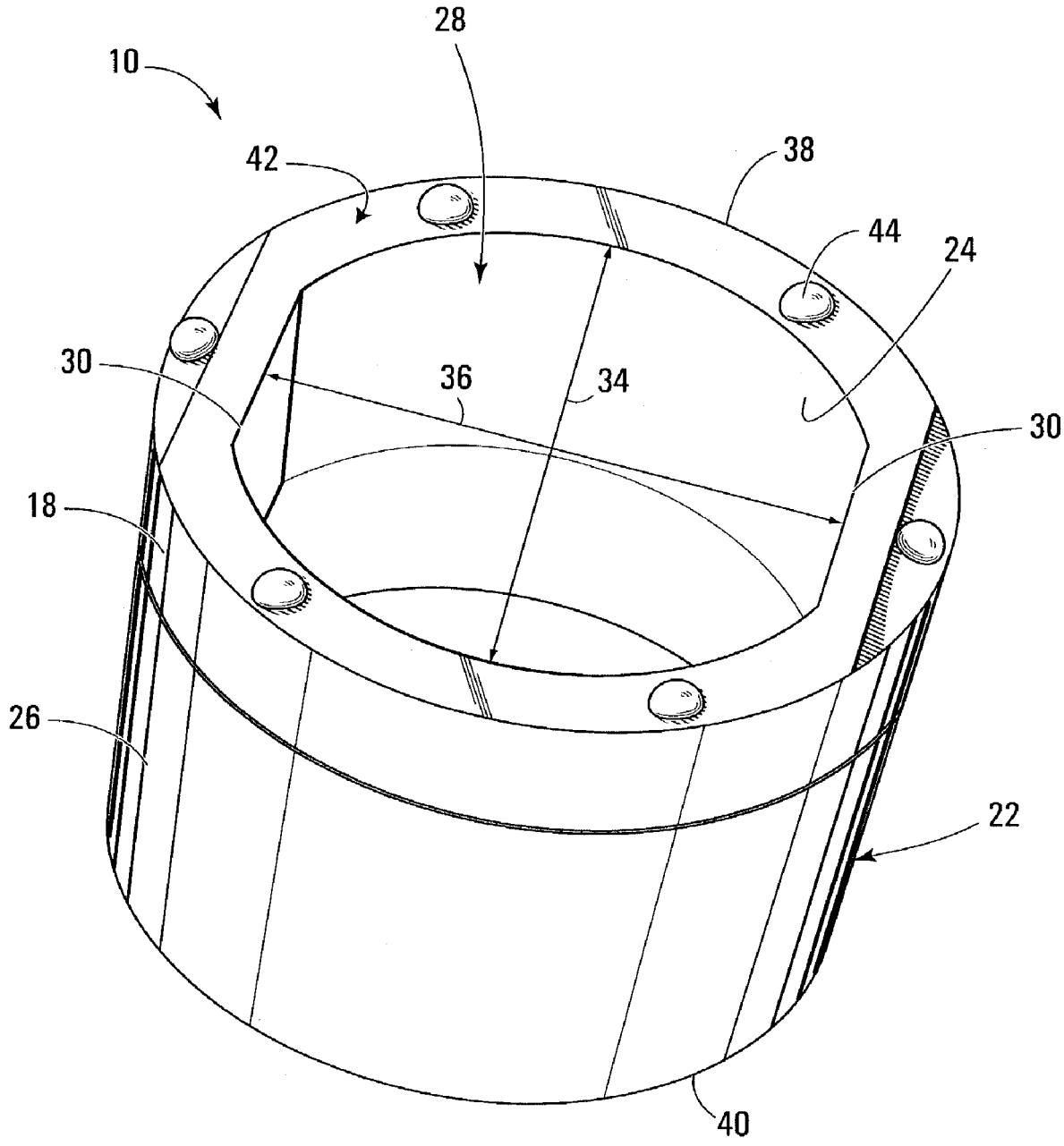
FIG. 2 shows a perspective view of a crown bit in accordance with a specific example of implementation of the present invention.

A crown bit 10 in accordance with a specific, non-limiting example of implementation of the present invention is shown in FIG. 2. Crown bit 10 includes a tubular body 22 having an inner surface 24 and an outer surface 26. In this specific example of implementation, the outer surface 26 is of a generally cylindrical shape, and the inner surface 24 circumscribes a hollow passageway 28 that is also of a generally cylindrical shape. In an alternative embodiment, the hollow passageway 28 is of a tubular shape having an oval cross section. The crown bit 10 further includes a pair of projections 30 that extend into the hollow passageway 28, substantially opposite one another on the inner surface 24. In the specific embodiment shown, the crown bit 10 includes only the two projections 30, positioned substantially opposite one another on the inner surface 24. Note however, that the present invention is not limited to any specific number of projections 30. As will be described in more detail further on in the specification, the projections 30 are adapted for engaging the driver drill bit 12, for releasably connecting the crown bit 10 and the driver drill bit 12 together in locking engagement.

As seen in FIG. 2, the hollow passageway 28 of the crown bit 10 is characterized by a maximum diameter 34, and a minimum diameter 36. The minimum diameter 36 is defined between the projections 30. Specific to the present invention, the projections 30 are positioned on the inner surface 24 according to a particular configuration whereby the amount of contiguous inner surface area 24 defining the maximum diameter 34 is maximized.

By positioning the projections 30 opposite one another, the projections 30 are positioned such that the amount of contiguous inner surface area 24 defining the maximum diameter 34 is maximized. If additional projections are used 30, they are also positioned opposite one other such that the amount of contiguous inner surface area 24 defining the maximum diameter 34 is maximized.

Figure 3A:
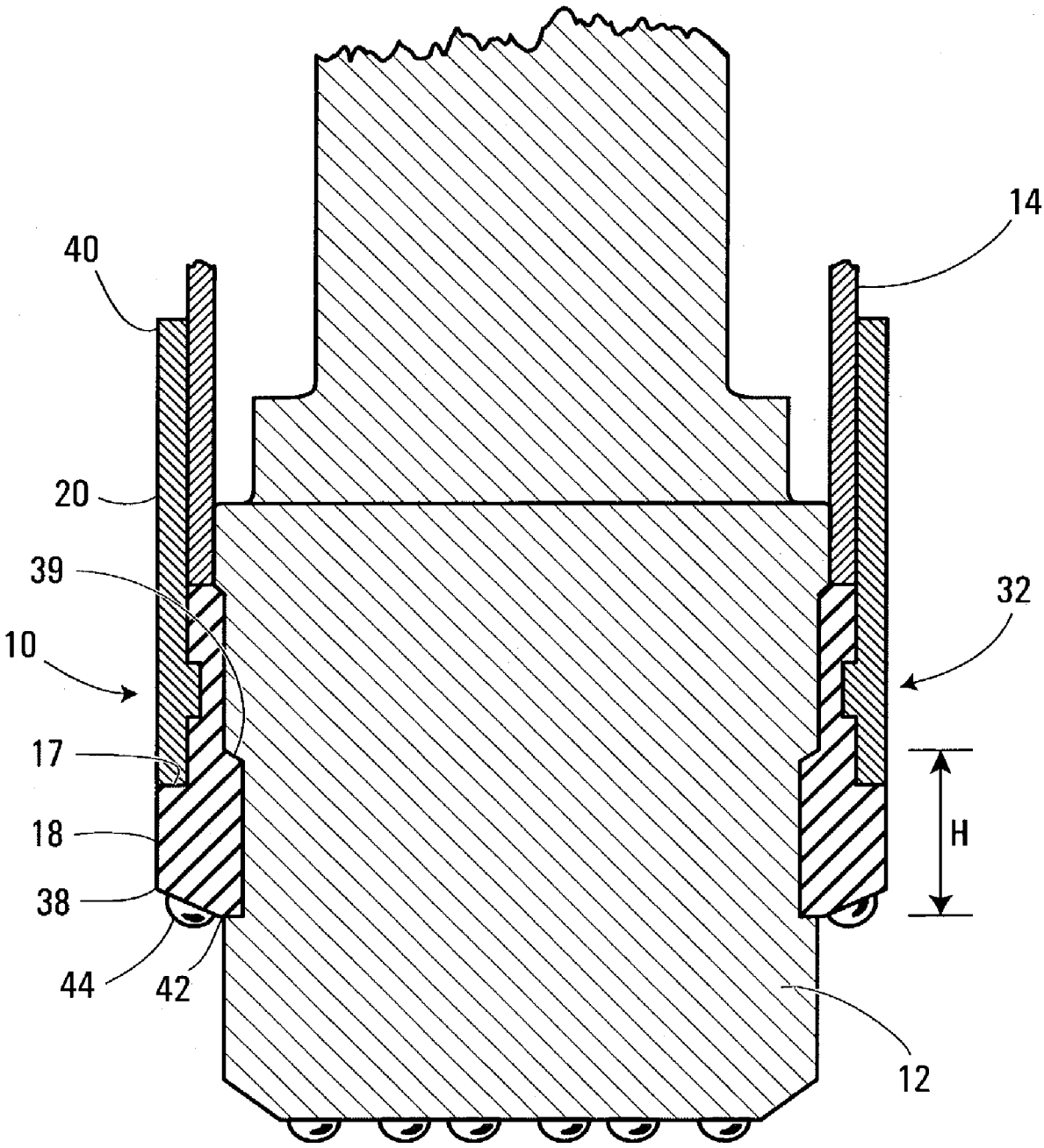
FIG. 3*a* shows a cross sectional view of the crown bit of FIG. 1 engaged with a driver drill bit via a mechanical connection in accordance with a first specific example of implementation of the present invention.

In the specific example of implementation shown in FIG. 2, the projections 30 are in the shape of substantially flat parallel wall portions. However, it should be understood that projections 30 of other shapes and sizes are also included within the scope of the present invention, as are projections 30 that are each of a different shape and size. For example, the projections 30 could be round or semi-round in shape. In addition, it should be understood that the height H of the projections, as shown in FIG. 3*a*, can vary without departing from the spirit of the invention. For example, the height H of the projections may span the entire height of the crown bit 10.

In the specific example of implementation shown in FIGS. 2 and 3*a*, the crown bit 10 includes a ring bit 18 and a driving shoe 20. It is the ring bit 18 that is adapted to be connected to the driver drill bit 12 and it is the driving shoe 20 that is adapted to be connected to the casing 14. Furthermore, crown bit 10 includes a drilling end 38 and a connection end 40. The connection end 40 is adapted to be fixedly connected to casing 14 via bolts, threads, weldings or any other connection method known in the art. It should be understood that although the casing is shown in FIG. 3*a* to be connected on the interior surface of the driving shoe 20, it can also be connected on the exterior surface, or on the tip of the connection end 40 itself.

The drilling end 38 includes a drilling face 42 having drilling organs 44 that assist in digging up the earth. The drilling organs 44 can be carbide inserts, tool steel inserts, steel teeth, or any other type of insert that helps the drilling face 42 dig up the earth. In addition, in the specific example of implementation shown, the pair of projections 30 are positioned at the drilling end 38 of the crown bit 10. However, it is within the scope of the invention for the pair of projections 30 to be positioned at any height along the hollow passageway 28 of the crown bit 10.

Figure 3B:
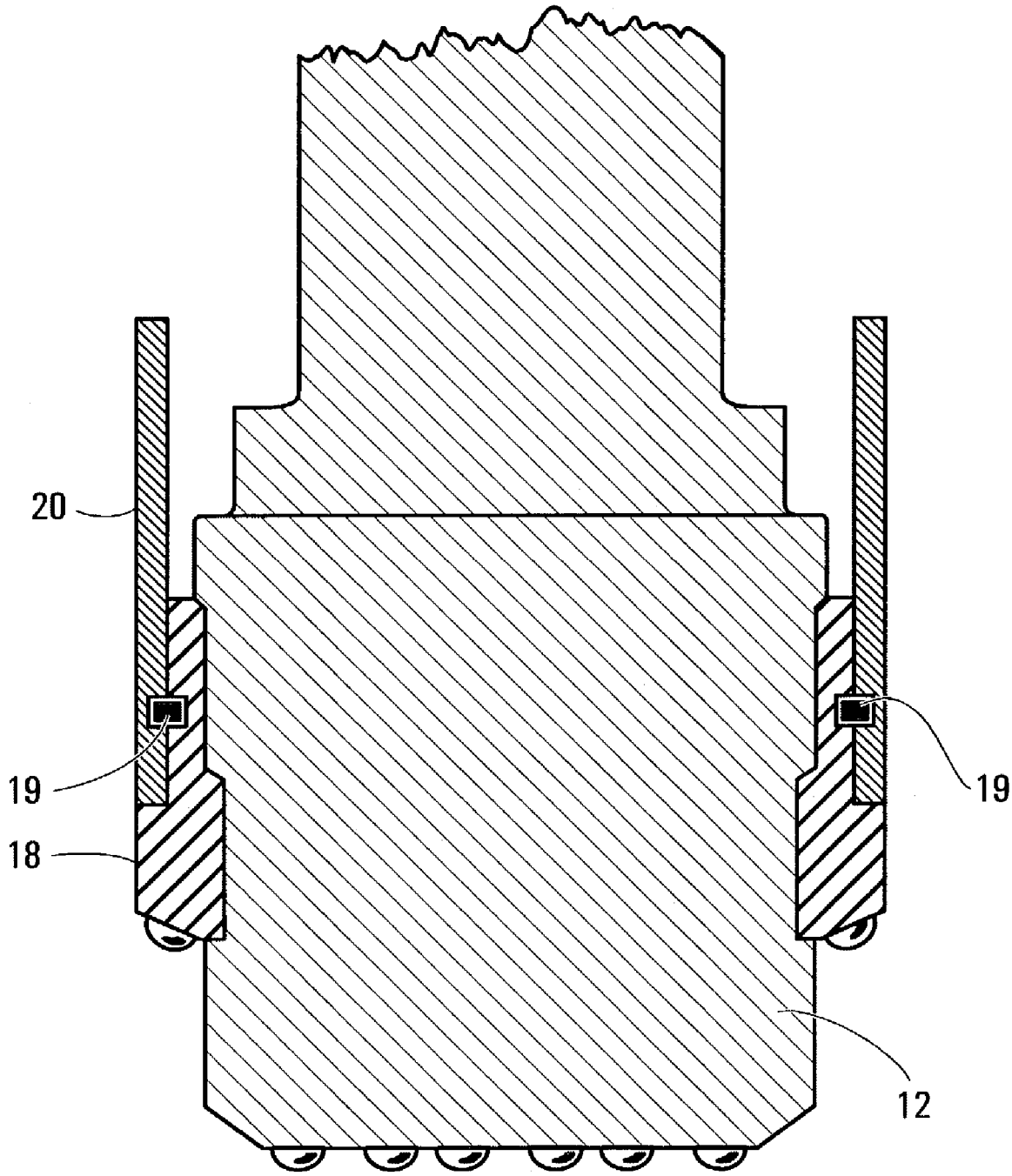
FIG. 3*b* shows a cross sectional view of a crown bit engaged with a driver drill bit via a mechanical connection in accordance with a second specific example of implementation of the present invention.

As shown in FIG. 3*a*, in a first specific example of implementation, the ring bit 18 and the driving shoe 20 are adapted to be connected to one another via a mechanical connection consisting of corresponding grooves and projections 32, that enable the ring bit 18 to rotate independently of the driving shoe 20, which remains immobile. As such, the ring bit 18 is able to rotate with the driver drill bit 12 in order to drill the hole, while the driving shoe 20 moves down the hole without rotating, such that the casing 14 does not rotate while it is being pulled down the hole. The grooves and projections 32 of the mechanical connection shown in FIG. 3*a* create a swivel zone where the groove and the projection 30 contact one another. Shown in FIG. 3*b* is an alternative embodiment of a mechanical connection consisting of a third component. The mechanical connection shown in FIG. 3*b* includes a removable resilient member 19, such as a spring, for example, that fits within a groove in the ring bit 18 and the driving shoe 20. This alternative embodiment creates two swivel zones, instead of just one; namely a first swivel zone between the ring bit 18 and the removable resilient member 19, and a second swivel zone between the removable resilient member 19 and the driving shoe 20. In yet another alternative embodiment (not shown), the ring bit 18 and the driving shoe 20 are integrally formed such that the casing 14 and the crown bit both rotate along with the driver drill bit 12 as they are pulled into the hole. In a still further alternative embodiment (not shown) there is no driving shoe 20, such that the casing 14 is connected directly to the ring bit 18. As such, although the crown bit 10 shown in the Figures includes both a ring bit 18 and a shoe bit 20, it should be understood that crown bits 10 in accordance with the present invention can consists of a single component that is able to connect to both the casing 14 and the driver drill bit 12, or alternatively the crown bit 10 may include more parts than just the ring bit 18 and shoe bit 20.

As shown in FIG. 3*a*, the purpose of the driving shoe 20 is to connect the casing 14 to the ring bit 18. The driver drill bit 12 does not come into contact with the driving shoe 20 when engaged with the crown bit 10. As such, all the force from the driver drill bit 12 is transmitted to the crown bit 10 through ring bit 18. More specifically, all the force from the driver drill bit 12 is imparted to the ring bit 18 from surfaces 39 and 41 of the driver drill bit 12 to the projections 30 and the upper lip of ring bit 18. Although it is within the scope of the present invention for the driver drill bit to contact the ring bit 18 at fewer surfaces, for safety reasons it is better for the force being transmitted from the driver drill bit 12 to the ring bit 18 to be spread over a larger surface area.

In order to manufacture the crown bit 10 of the present invention, the ring bit 18 and the driving shoe 20 are formed separately. Firstly, a metal ring is placed over the ring bit 18 such that it sits on ledge 17 shown in FIG. 3. Then, the driving shoe 20 is cut open such that it does not form a closed cylinder. In other words it is cut open along its peripheral edge such that there is a cut from one end of the cylinder to the other end. With the help of a hydraulic cylinder, the driving shoe 20 is pried open such that it is able to be wrapped around the ring bit 18, such that its projection enters the groove of the ring bit 18, thereby forming the groove and projection assembly 32, as described above. Again with the help of hydraulic machinery, the driving shoe is closed such that it can be welded together along its cut edge, and welded along its periphery to the metal ring that was placed around the ring bit 18. The metal ring helps to keep the driving shoe 20 closed once it has been welded together. In other words, it acts to reinforce the weld along the cut edge. Once welded shut, the outer surface of the driving shoe 20 is machined such that a smooth outer surface is formed.

Shown in FIGS. 4, 5, 6 and 7 is a driver drill bit 12 in accordance with a specific, non-limiting example of implementation of the present invention. The driver drill bit 12 includes a shank 46 and a drilling head 48. In the specific example of implementation shown, the shank 46 is integrally formed with the drilling head 48. The shank 46 is adapted to be connected to a hammer that is operative to transmit force, vibration and rotational motion to the driver drill bit 12 such that the drilling head 48 can drill through the earth. Such hammers are well known in the art and, as such, will not be described in more detail herein.

The drilling head 48 is the portion of the driver drill bit 12 that is adapted for drilling through the overburden material. The drilling head 48 includes a portion designated by height H2, that is operative to extend through the crown 10, as shown in FIG. 3*a*, such that it is able to drill a sink into the bedrock. The sink provides enough room for the cut-away portions of a square drill bit 16, which will be described in more detail further on, to pass through the hollow passageway 28 of the crown bit, into the bedrock. In addition, the sink helps to center the casing 14 and the square drill bit 16 when the square drill bit 16 is inserted into the hole.

The drilling head 48 further includes a drilling face 50 and a peripheral surface 52. The drilling face 50 includes drilling organs 51 for displacing the earth being drilled. As mentioned above with respect to the crown bit 20, the drilling organs 51 can be carbide inserts, tool steel inserts, steel teeth, or any other type of insert that helps the drilling face 50 dig up the earth.

Figure 7:
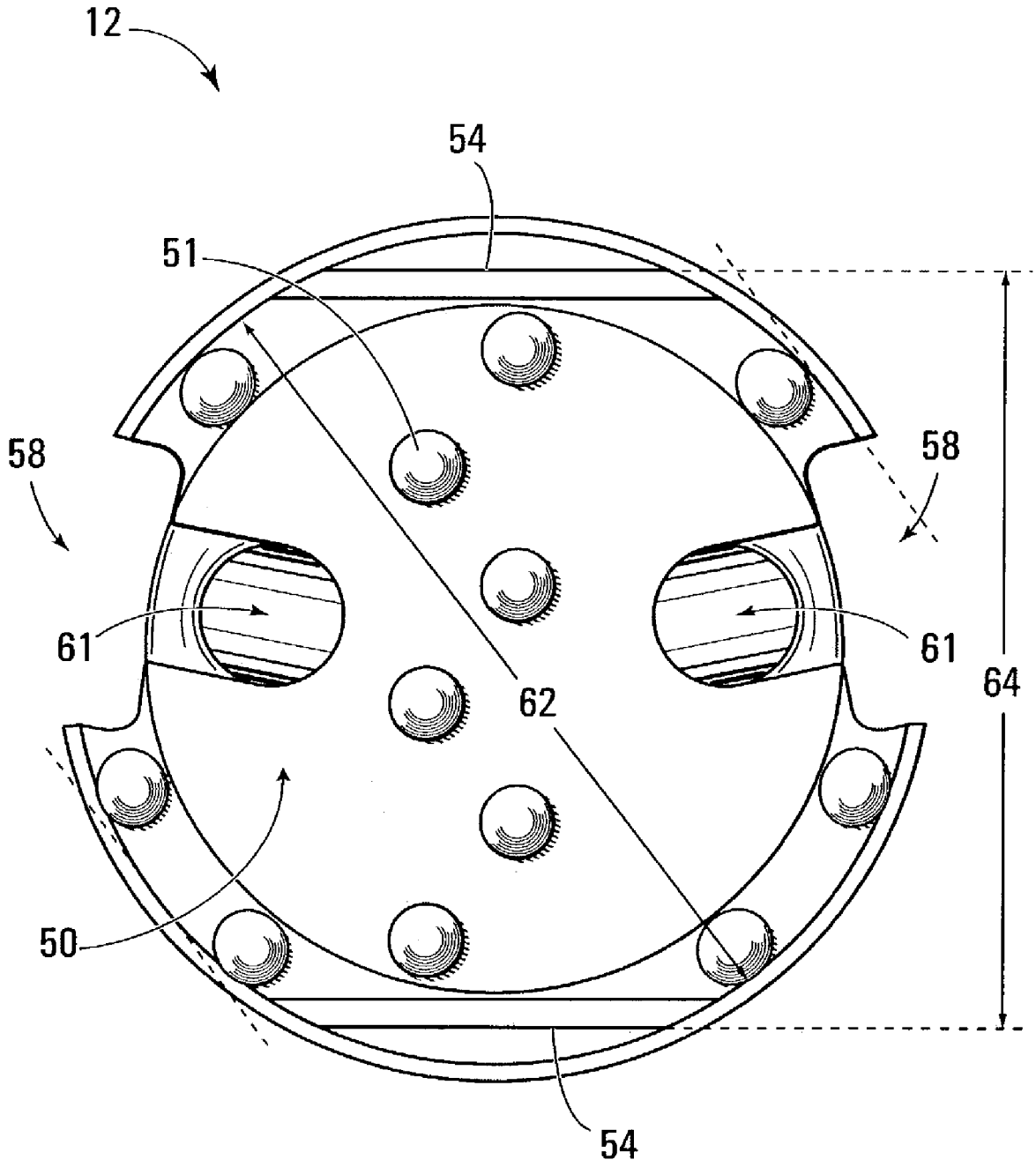
FIG. 7 shows a top plan view of the driver drill bit of FIG. 4.

The peripheral surface 52 is of a substantially cylindrical shape with two tapered cut-away portions 54 positioned opposite one another (as best seen in FIG. 7). In addition, the peripheral surface 52 includes a pair of locking surfaces 56. The two tapered cut-away portions 54 each provide an access-way to a respective locking surface 56. In the specific embodiment shown in FIGS. 4 and 5, each locking surface is a flat surface that extends from a respective tapered cut-away portion 54, such that the plane of a tapered cut-away portion 54 and the plane of the respective locking surface 56, are angled with respect to one another. In the specific embodiments shown in FIGS. 4 and 5, the locking surfaces 56 each include a transition portion 57. These transition portions 57 are characterized by a plane that intersects the plane of a respective tapered cut away portion 54 and the plane of a respective locking surface 56. The plane of each transition portion 57 is less angled with respect to the plane of the tapered cut-away portion 54 than is the plane of the locking surface 56.

Figure 4:
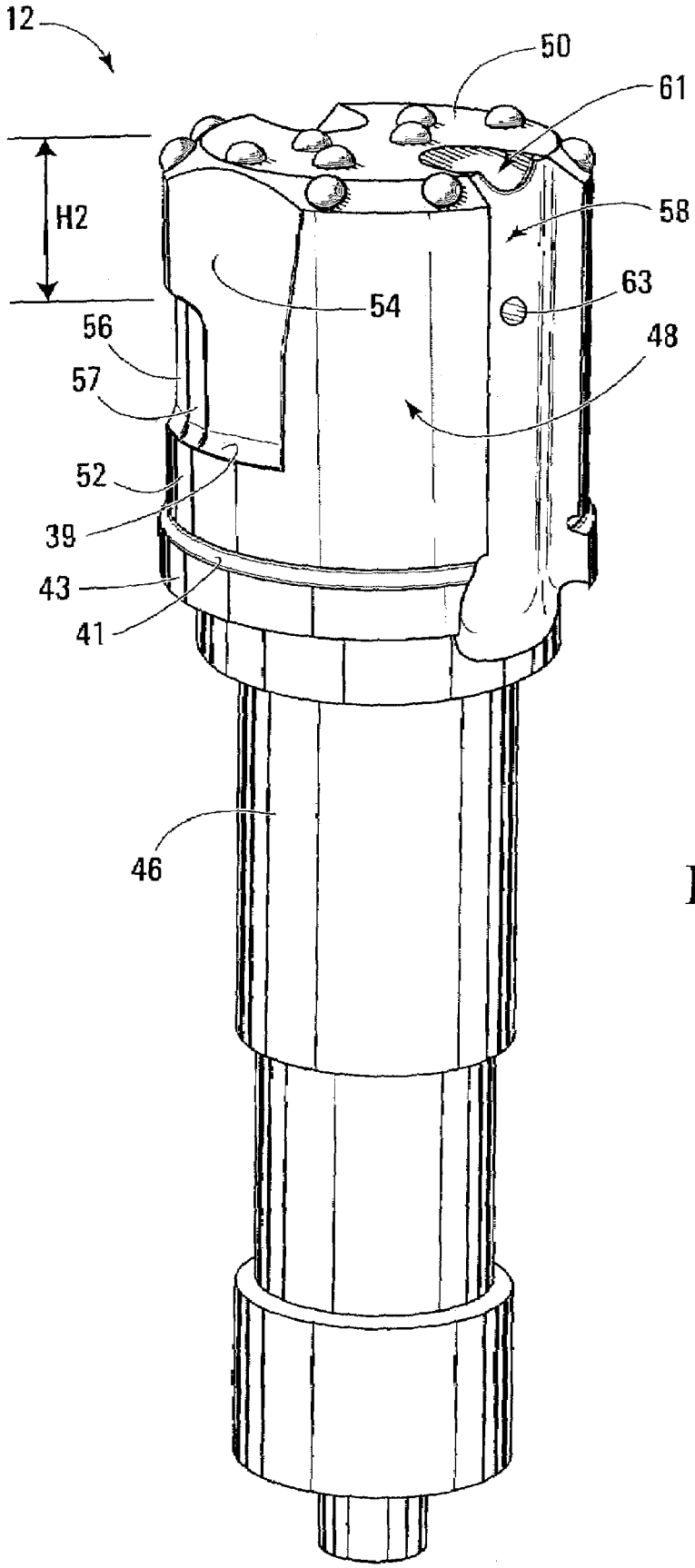
FIG. 4 shows a perspective view of a driver drill bit in accordance with a specific example of implementation of the present invention.
Figure 5:
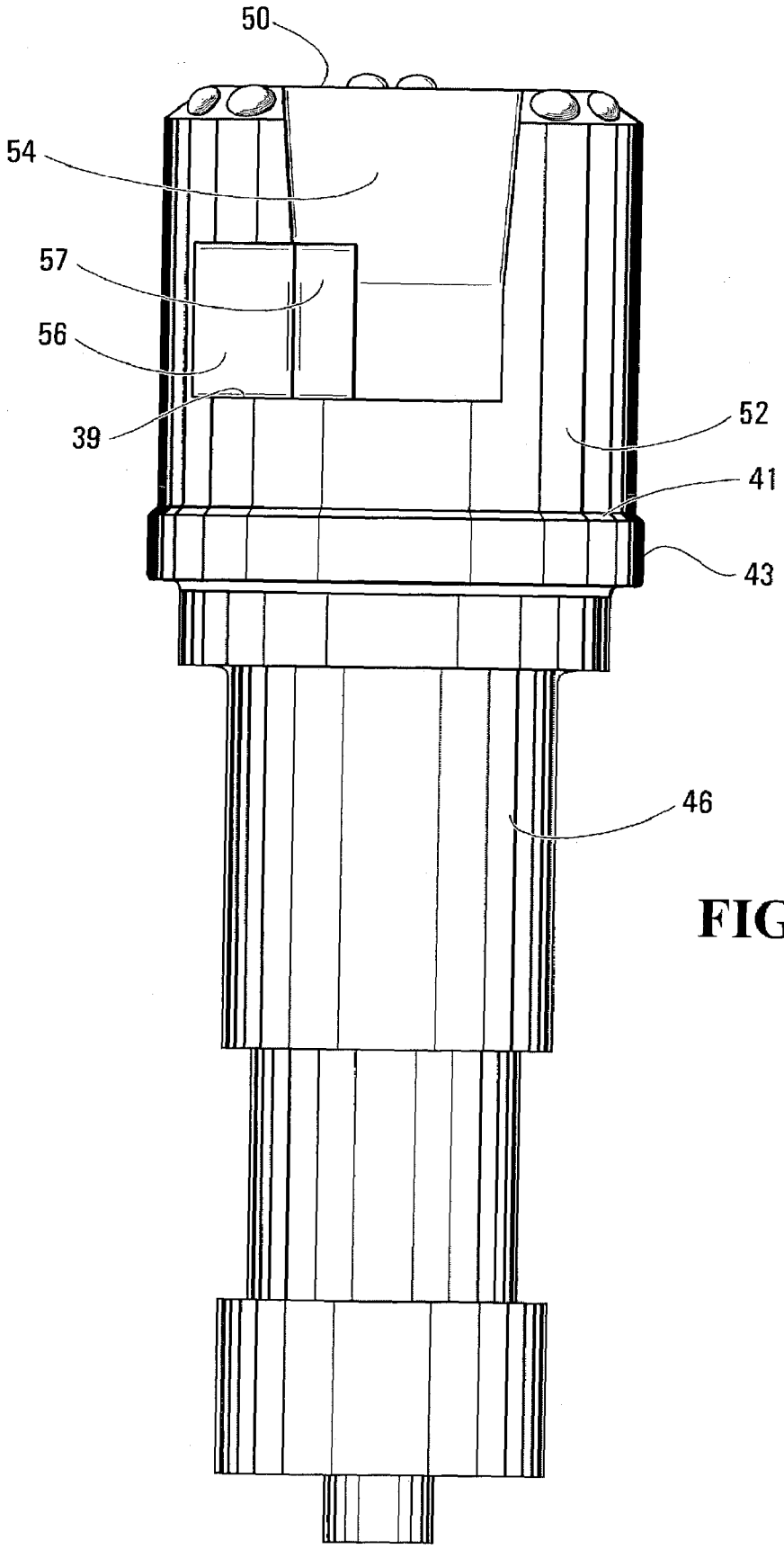
FIG. 5 shows a first side view of the driver drill bit shown in FIG. 4.
Figure 6:
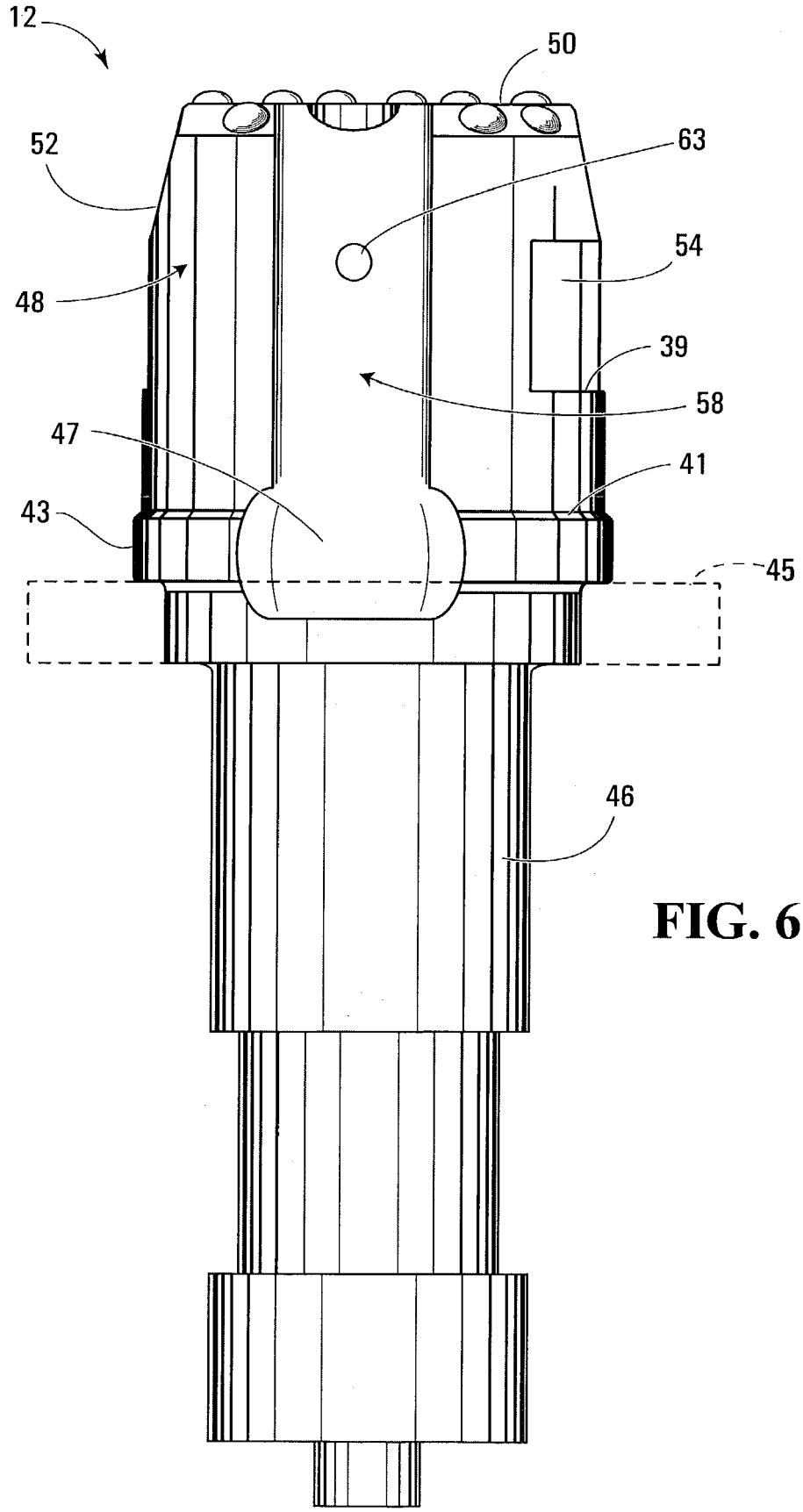
FIG. 6 shows a second side view of the driver drill bit shown in FIG. 4.

In the specific embodiment shown in FIGS. 4, 5 and 6, the longitudinal axes of the tapered cut-away portions 54 are substantially parallel to the longitudinal axis of the driver drill bit 12, and the longitudinal axes of the locking surfaces 56 are parallel to a tangent of the peripheral surface 52 of the drilling head 48. It should, however, be understood that the locking surfaces 56 could be short enough that their longitudinal axes are also parallel to the longitudinal axis of the driver drill bit 12.

As shown in FIGS. 4, 5 and 6, at the junctions between the peripheral surfaces 52 and the locking surfaces 56 are ledges that form surfaces 39. In addition, the drilling head 48 further includes a peripheral ring 43 that forms a surface 41. As described above with respect to FIG. 3*a*, surfaces 39 and 41 are operative for enabling the driver drill bit 12 to impart force and vibration to the ring bit 18 of the crown bit 10.

As shown in FIGS. 4, 6 and 7, drilling head 48 further includes a pair of flushing passageways 58. The flushing passageways 58 enable debris to pass therethrough in order to clear out the hole being drilled. In addition, the drilling head 48 includes a pair of air channels 61, and a pair of air holes 63 (one air hole 61 and one air hole 63 per flushing passageway 58) for enabling air to descend into the hole during drilling and for helping the debris to pass through the flushing passageways 58. Flushing passageways 58 can be positioned directly opposite one another, or in an alternative example of implementation, the flushing passageways 58 can be positioned anywhere along the peripheral surface 52 of the drilling head 48.

As shown in FIG. 6, the drilling head 48 includes a rotational-friction zone 45. When the crown bit 10 and the driver drill bit 12 are in use, the ring bit 18 covers most of the flushing passageway 58 and since the ring bit 18 and the drilling head 48 both rotate together, they form a tube with flushing channel 58 for the debris to pass through. However, in the rotational-friction zone, the end bit 47 of flushing passageway 58 is covered by the casing 14. Since the casing 14 remains immobile while the drilling head 48 rotates, the debris contained within the end bit 47 of the flushing passageway 58 is exposed to friction between the immobile casing 14 and the rotating end bit 47 of the flushing passageway 58. This friction causes the debris to be ground up which helps to enable it to exit the flushing passageway 58 more easily, and to travel up through the casing 14 to the top of the hole being dug.

Figure 8:
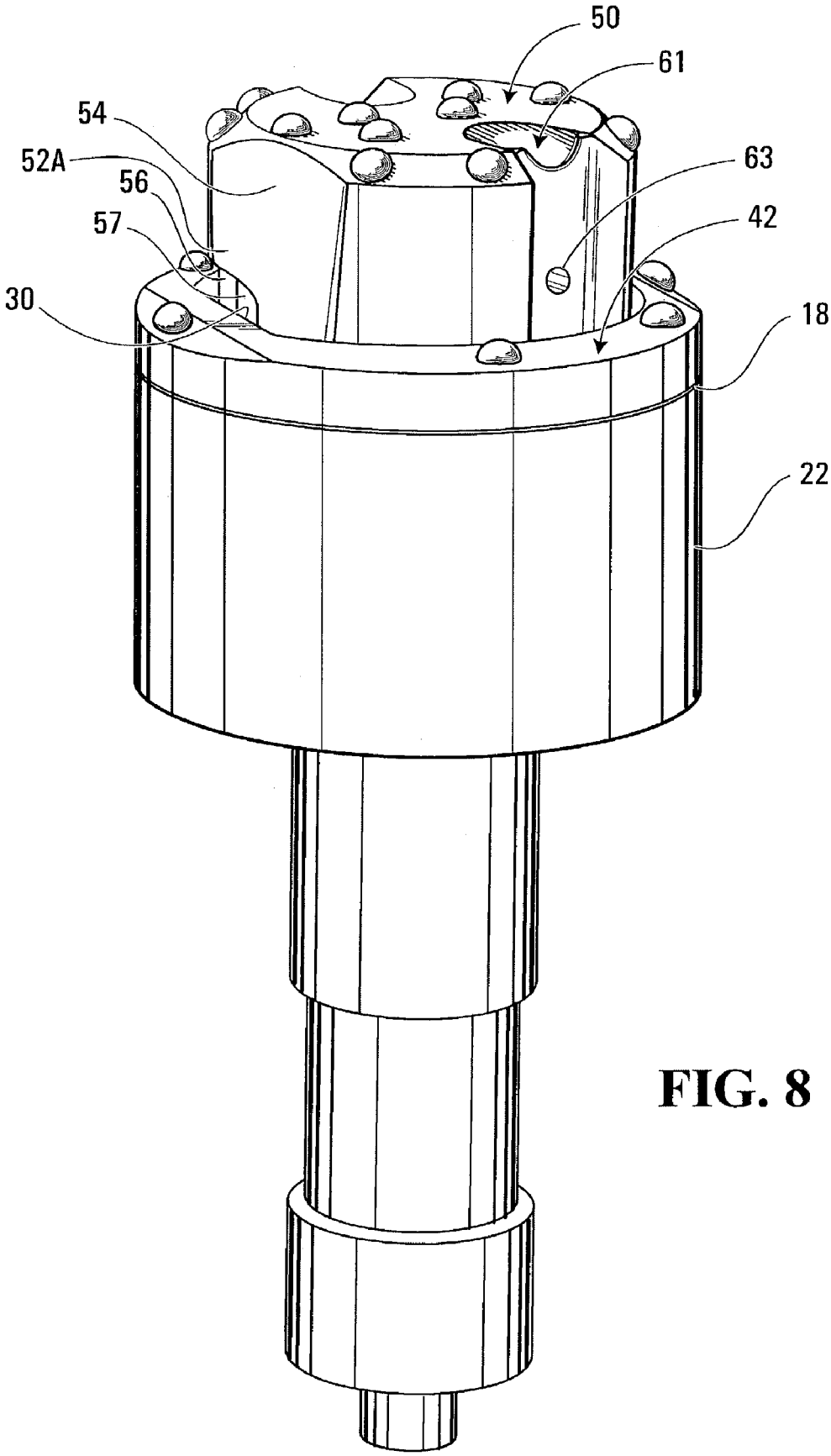
FIG. 8 shows a side perspective view of the driver drill bit of FIG. 4 connected in locking engagement with the crown bit shown in FIG. 1, in accordance with a specific example of implementation of the present invention.

Referring now to FIG. 8, the process for connecting and disconnecting the driver drill bit 12 and the crown bit 10 will be described. The first step in the connection process is to insert the drilling face 50 of the driver drill bit 12 through the hollow passageway 28 of the crown bit 10. In order for the drilling face 50 to fit through the hollow passageway 28, the pair of cut-away portions 54 are aligned with the pair of projections 30. As shown in FIG. 7, the drilling head 48 is characterized by a first diameter 62 and a second diameter 64. The first diameter is the diameter of the generally cylindrical portion of the drilling head 48 and the second diameter 64 is defined as the distance between the pair of cut-away portions 54. The first diameter 62 is slightly smaller than the maximum diameter 34 of the crown bit 10, and the second diameter 64 is slightly smaller than the minimum diameter 36 of the crown bit 10, such that the drilling face 50 of the driver drill bit 12 is able pass through the hollow passageway 28 of the crown bit 10, when the cut-away portions 54 are aligned with the pair of projections 30.

FIG. 8 shows the driver drill bit 12 and the crown bit 10 in locking engagement. In order to create the locking engagement between the driver drill bit 12 and the crown bit 10, the drilling head 48 of the driver drill bit 12 is passed through the hollow passageway 28 of the crown bit 10 until the pair of locking surfaces 56 are aligned with the pair of projections 30. At that point, either the drilling head 48, the crown bit 10, or both, are turned, such that the pair of projections 30 of the crown bit 10 engage the locking surfaces 56 of the driver drill bit 12. As shown in FIG. 8, once the pair of projections 30 and the locking surfaces 54 are engaged, a portion 52*a* of the peripheral surface 52 of the drilling head 48, overlaps the projections 30, thereby preventing the drilling head 48 from being removed from the crown bit 10. Furthermore, once in locking engagement, the driver drill bit 12 is able to impart rotational motion to the ring bit 18 of the crown bit 10 when the drill bit is rotated clockwise by the hammer of the drilling equipment. Therefore, it is the drilling face 50 of the drilling head 48 and the drilling face 42 of the crown bit 10 that drill the first portion of the hole through the overburden material.

In order to disconnect the driver drill bit 12 from the crown bit 10, either the driver drill bit 12, the crown bit 10 or both, are turned in the opposite direction, such that the pair of projections 30 and the pair of locking surfaces 56 disengage. Once disengaged, the drilling head 48 can be removed from the crown bit 10. This is typically done when the combination of the driver drill bit 12 and the crown bit 10 have finished drilling through the overburden as shown in FIG. 1*a*, and a square drill bit 14 is needed to complete the drilling through the bedrock.

Advantageously, the pair of projections 30 and the locking surfaces 56 enable a smooth transition for the crown bit 10 and driver drill bit 12 between the locked and unlocked positions. As such, the crown bit 10 and driver drill bit 12 experience minimal grinding and minimal wear when moving between the locked and unlocked positions.

Shown in FIGS. 9, 10, 11 and 12 is a specific, non-limiting example of implementation of a square drill bit 16 for use with the overburden drilling system of the present invention. The square drill bit 16 includes a shank 66 and a drilling head 68. Similarly to the shank 46 of driver drill bit 12, the shank 66 is adapted to be connected to a hammer which is able to transmit rotational motion and impart force and vibration to the square drill bit 16. As mentioned above, such drilling equipment is known in the art and, as such, will not be described in more detail herein.

Figure 9:
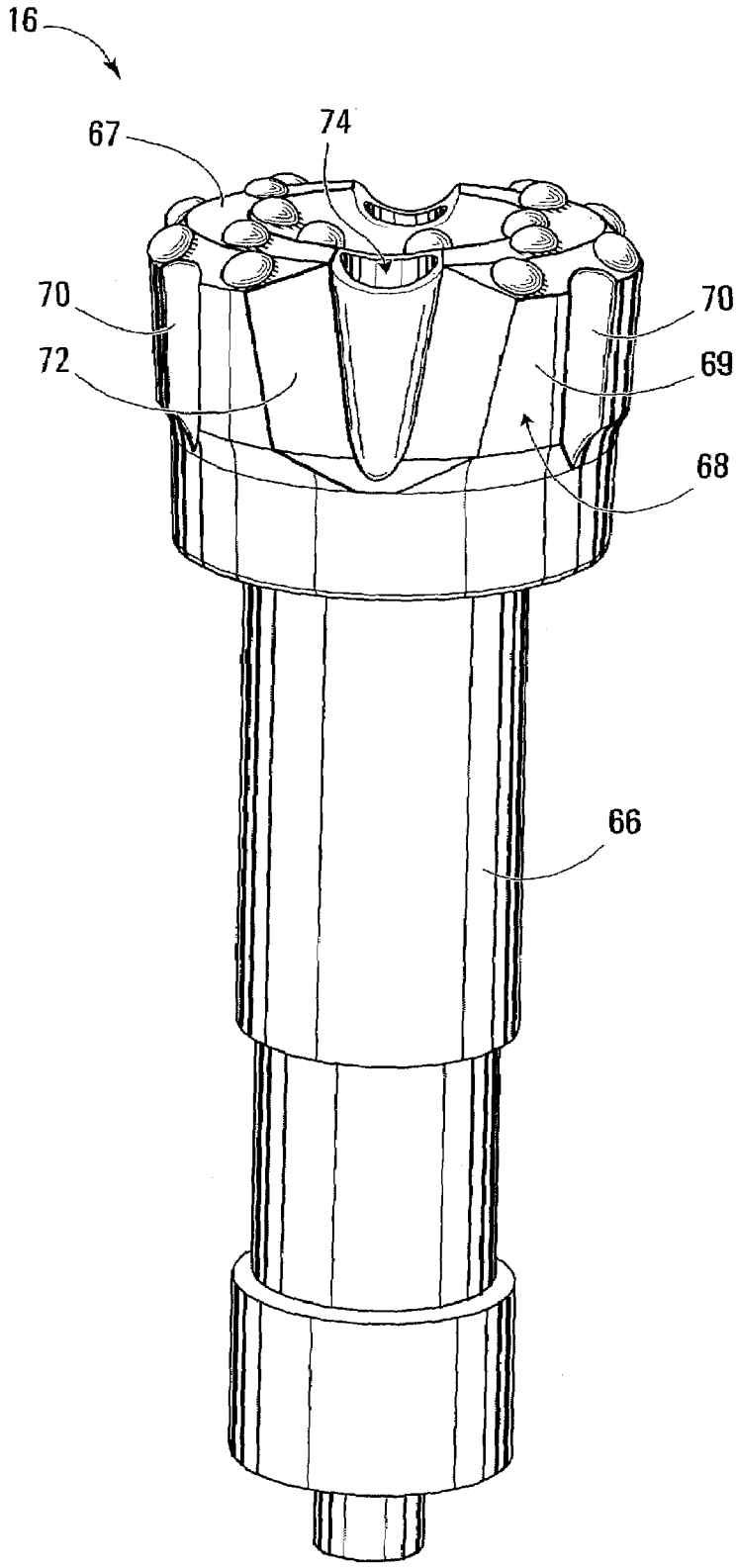
FIG. 9 shows a perspective view of a square drill bit in accordance with a specific example of implementation of the present invention.
Figure 11:
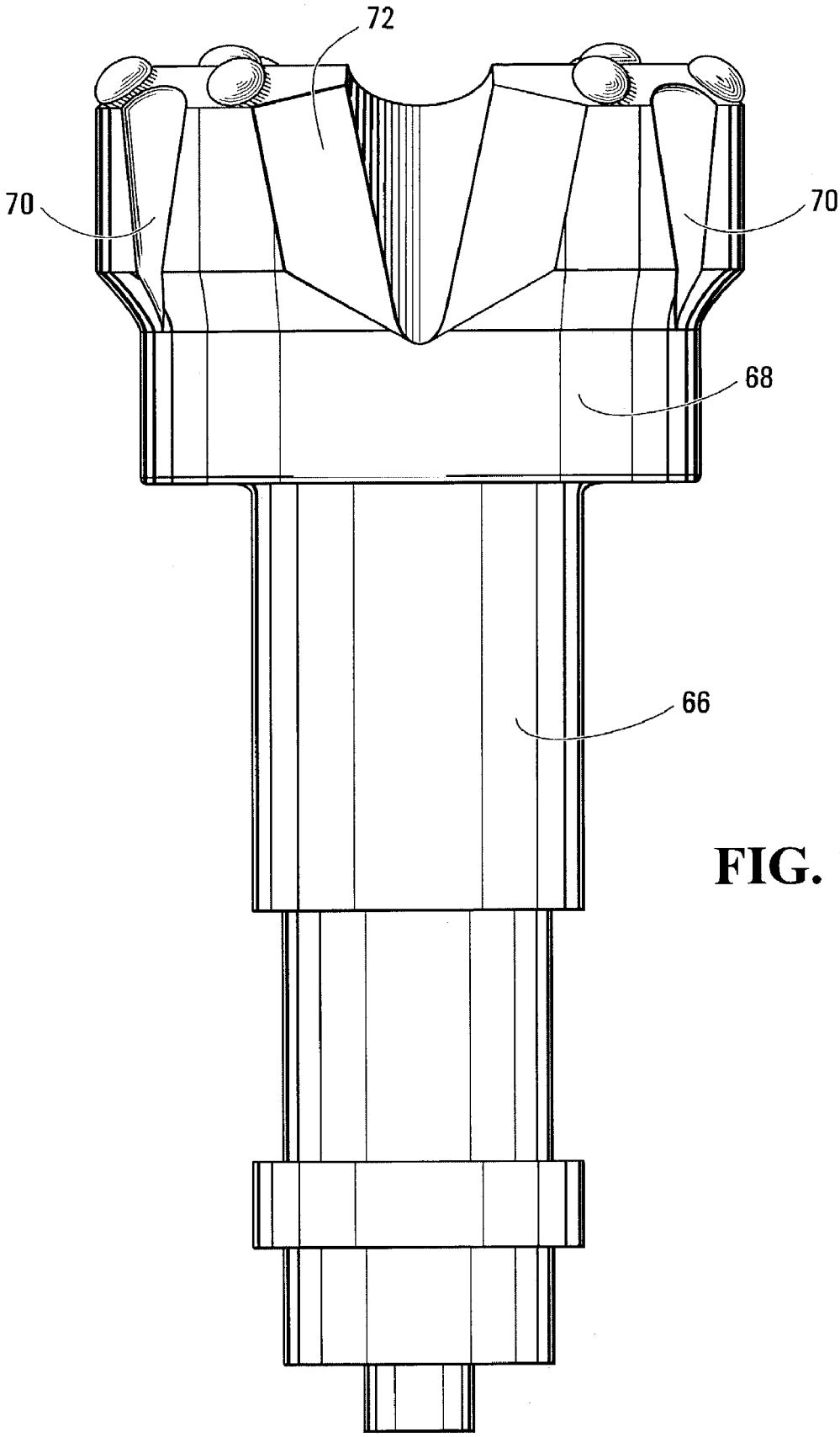
FIG. 11 shows a second side view of the square drill bit shown in FIG. 9.
Figure 12:
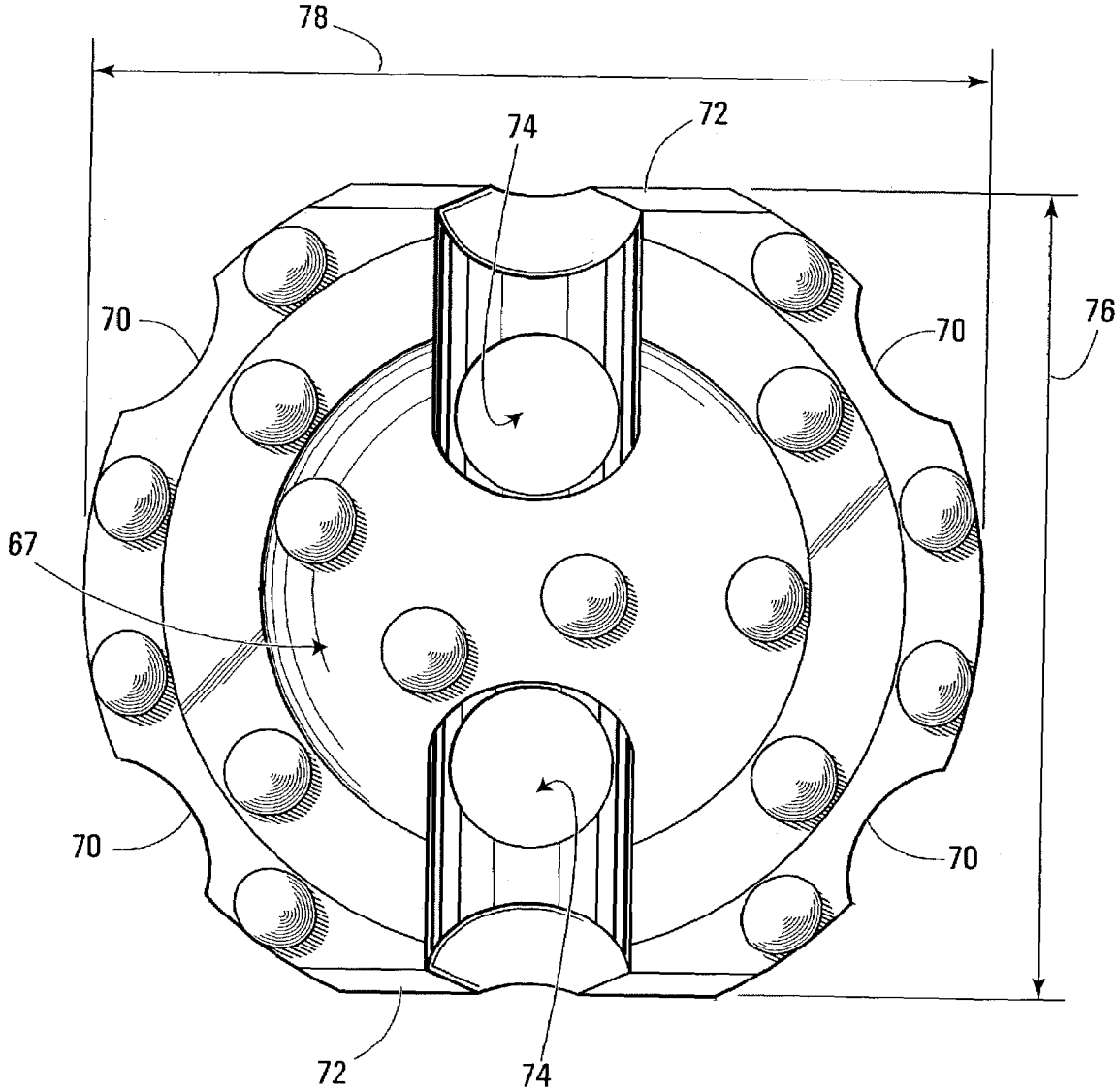
FIG. 12 shows a top plan view of the square drill bit of FIG. 9 positioned within the crown bit shown in FIG. 2, in accordance with a specific example of implementation of the present invention.

As shown in FIG. 9, the drilling head 68 includes a drilling face 67 and a peripheral surface 69 that is of a substantially tapered cylindrical shape. As shown in FIGS. 9, 11 and 12, the drilling head 68 includes a pair of tapered cut-away portions 72 that also act as flushing channels. These cut away portions 72 correspond to the projections 30 of crown bit 20, such that the drilling head 68 is able to pass through hollow passageway 28. In addition, tapered cut-away portions 72 also include air passages 74. In addition, these cut away portions 72 further enable the debris to pass through the hole.

Figure 10:
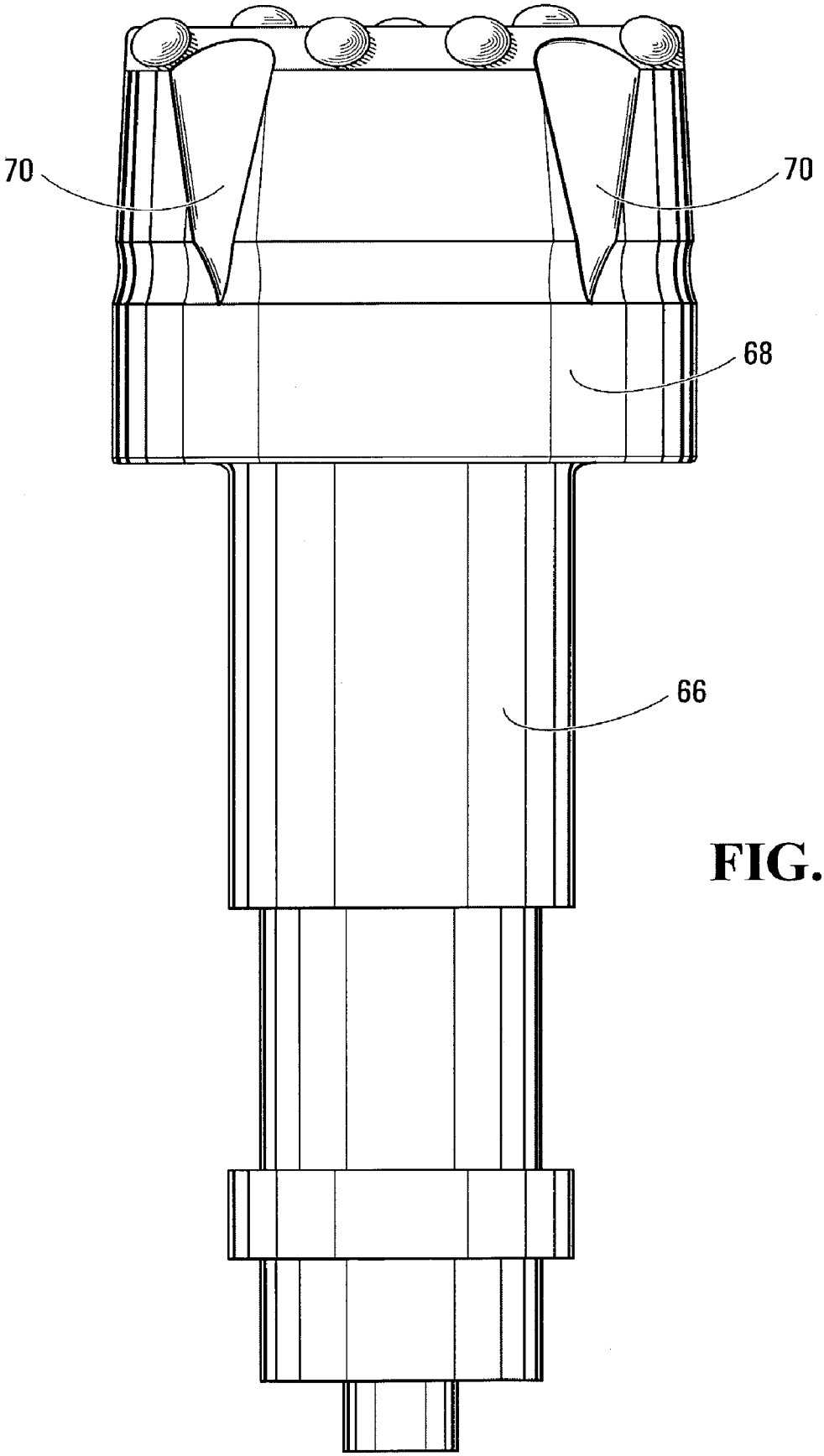
FIG. 10 shows a first side view of the square drill bit shown in FIG. 9.

As shown in FIGS. 10 and 12, the drilling head 68 of square drill bit 14 further includes a plurality of flushing channels 70 along its peripheral surface 69. These flushing channels 70 enable air to enter the hole during drilling and assist with the removal of debris from the hole.

Figure 13:
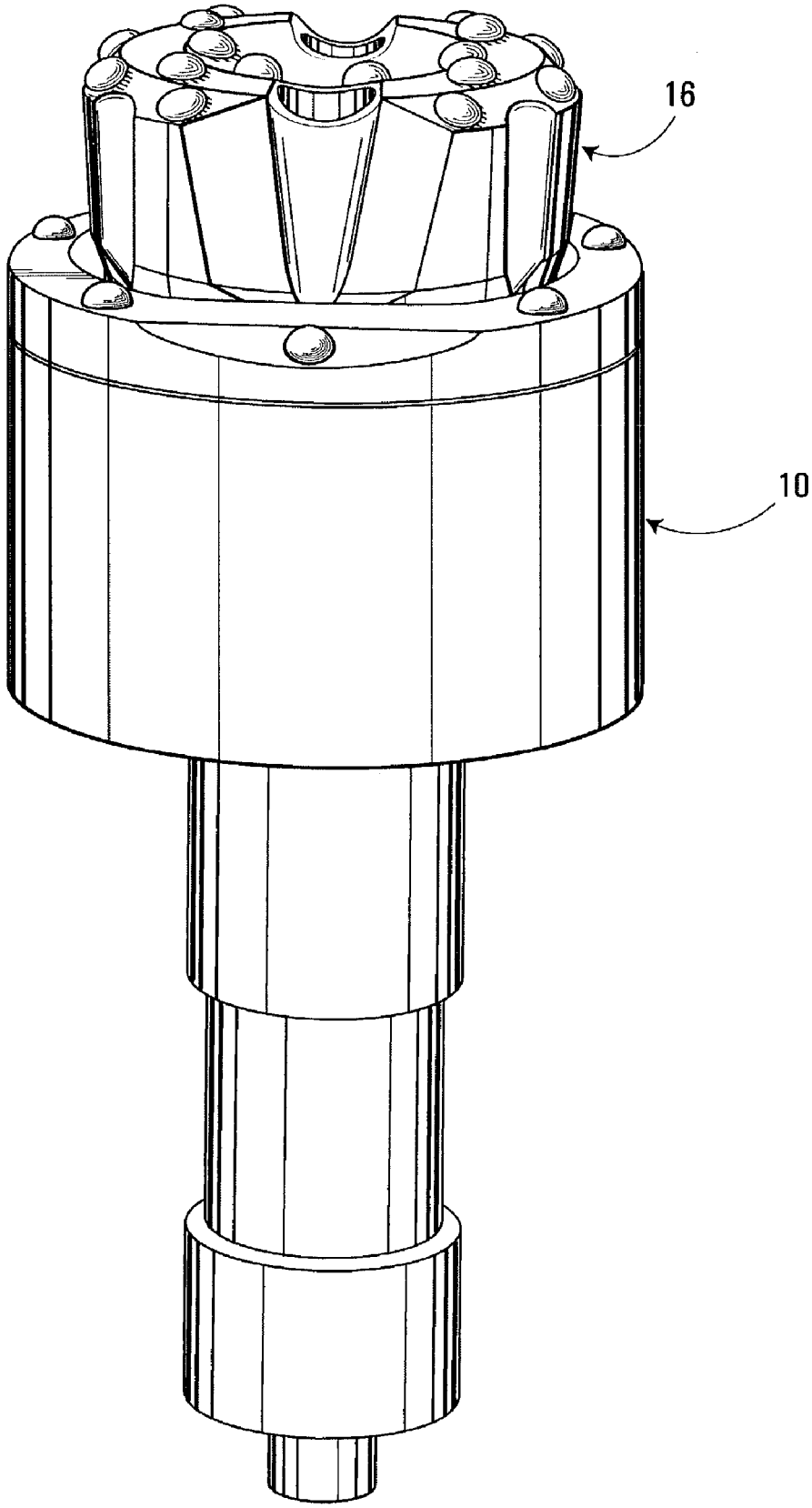
FIG. 13 shows a perspective side view of the square drill bit of FIG. 9 positioned within the crown bit shown in FIG. 2, in accordance with, a specific example of implementation of the present invention.

As shown in FIG. 12, the drilling face 67 of the square drill bit 14 is characterized by a maximum diameter 78, and a minimum diameter 76. In the specific example shown, the maximum diameter 78 is the diameter of the generally cylindrical portion of the drilling head 68, and the minimum diameter 76 is defined as the distance between the pair of tapered cut-away portions 72 that form flushing channels. The maximum diameter 78 of the square drill bit 14 is slightly smaller than the maximum diameter 34 of the crown bit 10, and the minimum diameter 76 is slightly smaller than the minimum diameter 36 of the crown bit 10. As such, in order to pass the square drill bit 14 through the hollow passageway 28 of the crown bit 10, the flushing passageways 72 are aligned with the pair of projections 30 of the crown bit 10. In this manner, the square drill bit having a maximum diameter 78 that is only slightly less than the maximum diameter 34 of the crown bit 10, and a minimum diameter 76 that is only slightly less than the minimum diameter 36 of the crown bit 10 is able to pass through the crown bit 10 and continue drilling into the bedrock. FIG. 13 shows square drill bit 14 being passed through crown bit 10. By positioning the projections 30 such that the amount of contiguous inner surface 24 area having the maximum diameter 34 is maximized, a square drill bit 16 having a diameter that is only slightly smaller than the maximum diameter of the hollow passageway 28 can pass through the crown bit 10 and be used to drill through the bedrock. As such, a casing and crown bit of industry standard size according to the present invention can receive a square drill bit of larger diameter than would be possible in existing systems for the same size casing and crown bit. As such, because a larger drill bit can be used, a larger hammer can be used which, advantageously enables a larger hole to be dug at a faster rate than with traditional smaller hammers, thereby increasing the efficiency of the system. In addition, the larger holes enable more flushing capability in medium to deep holes.

Figure 14:
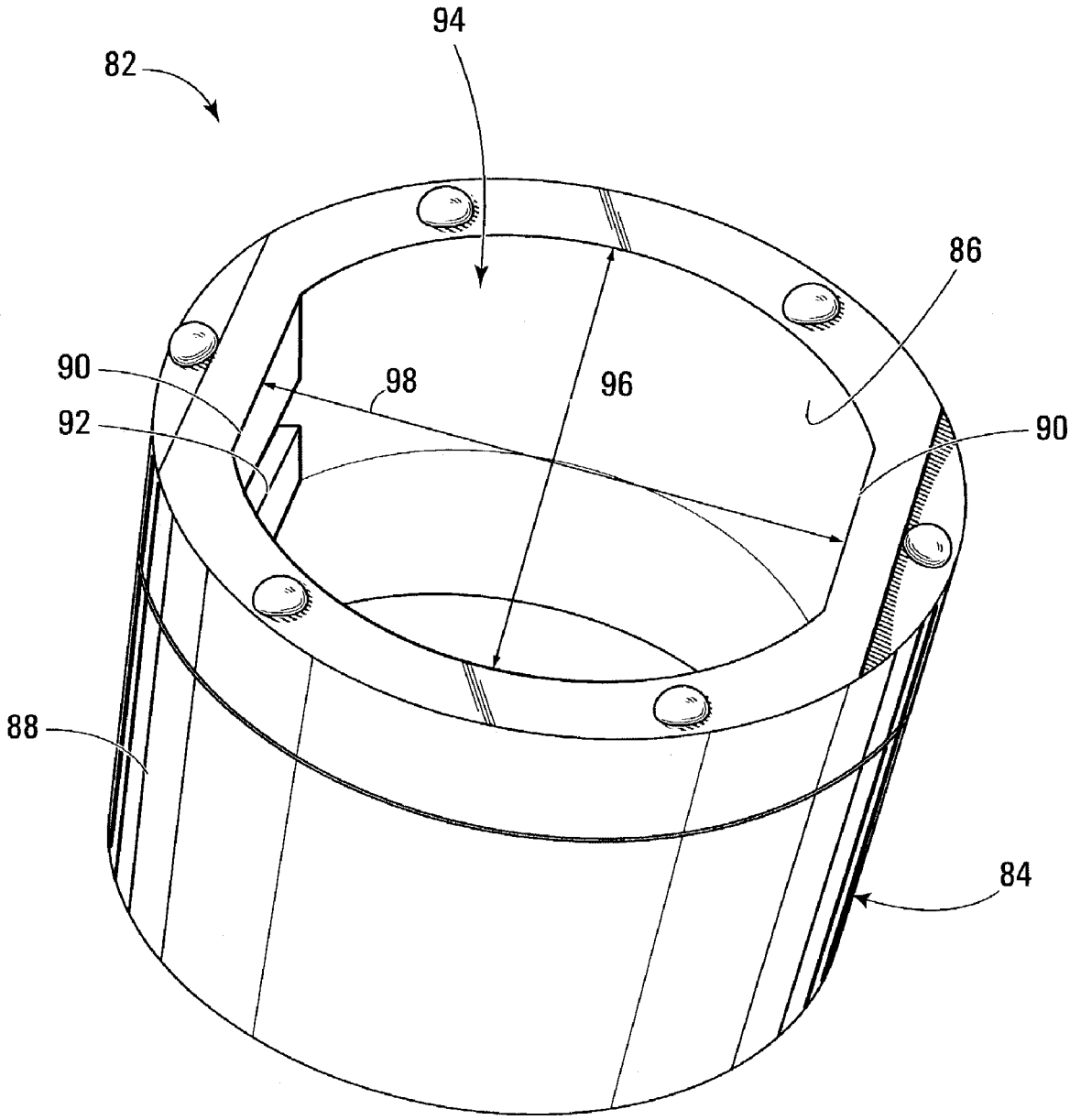
FIG. 14 shows a perspective view of a crown bit in accordance with an alternative example of implementation of the present invention.

Shown in FIG. 14 is a crown bit 82 in accordance with an alternative example of implementation of the present invention. Crown bit 82 includes a tubular body 84 having an inner surface 86 and an outer surface 88, wherein the inner surface 86 circumscribes a hollow passageway 94. The difference between crown bit 10 and crown bit 82 is that crown bit 82 includes two pairs of projections instead of just a single pair. More specifically, crown bit 82 includes a first pair of projections 90 and a second pair of projections 92. It should be noted that only one projection 92 is visible due to the angle of crown bit 82. Projections 90 and 92 extend into the hollow passageway 92 substantially opposite one another on the inner surface 86. As such, the hollow passageway 94 of the crown bit 82 is characterized by a maximum diameter 96, and a minimum diameter 98. The minimum diameter 98 is defined between the projections 90 and projections 92.

Figure 15:
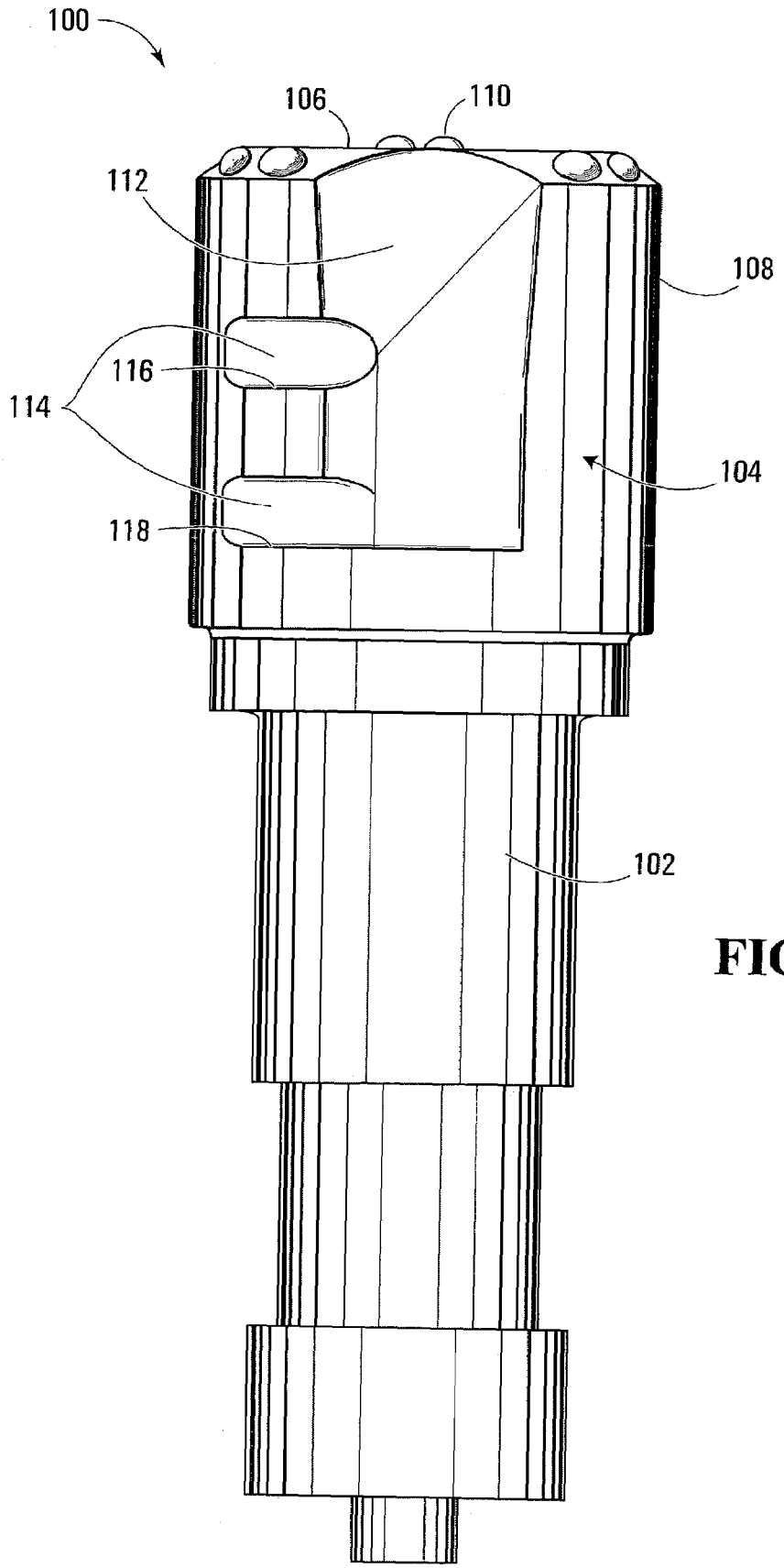
FIG. 15, shows a side view of a driver drill bit in accordance with an alternative example of implementation of the present invention

Shown in FIG. 15 is a driver drill bit 100 in accordance with an alternative example of implementation of the present invention. The driver drill bit 100 includes a shank 102 and a drilling head 104. The drilling head 104 includes a drilling face 106 and a peripheral surface 108. The drilling face 106 includes drilling organs 110 for displacing the earth being drilled. The peripheral surface 108 includes two tapered cut-away portions 112 that each provide an access-way to a pair of locking surfaces 114. Unlike the peripheral surface of the driver drill bit 12, the peripheral surface 108 of driver drill bit 100 does not include a peripheral ring that forms a surface for enabling the driver drill bit 108 to impart force to the crown bit 82. However, advantageously, each pair of locking surfaces 114 provides two surfaces, namely surfaces 116 and 118 along which the drilling head 104 can impart force and vibration to the projections 114 of the crown bit 82. As such, the two surfaces 116 and 118 help to make up for the fact that drilling head 104 does not include a peripheral ring.

Figure 16:
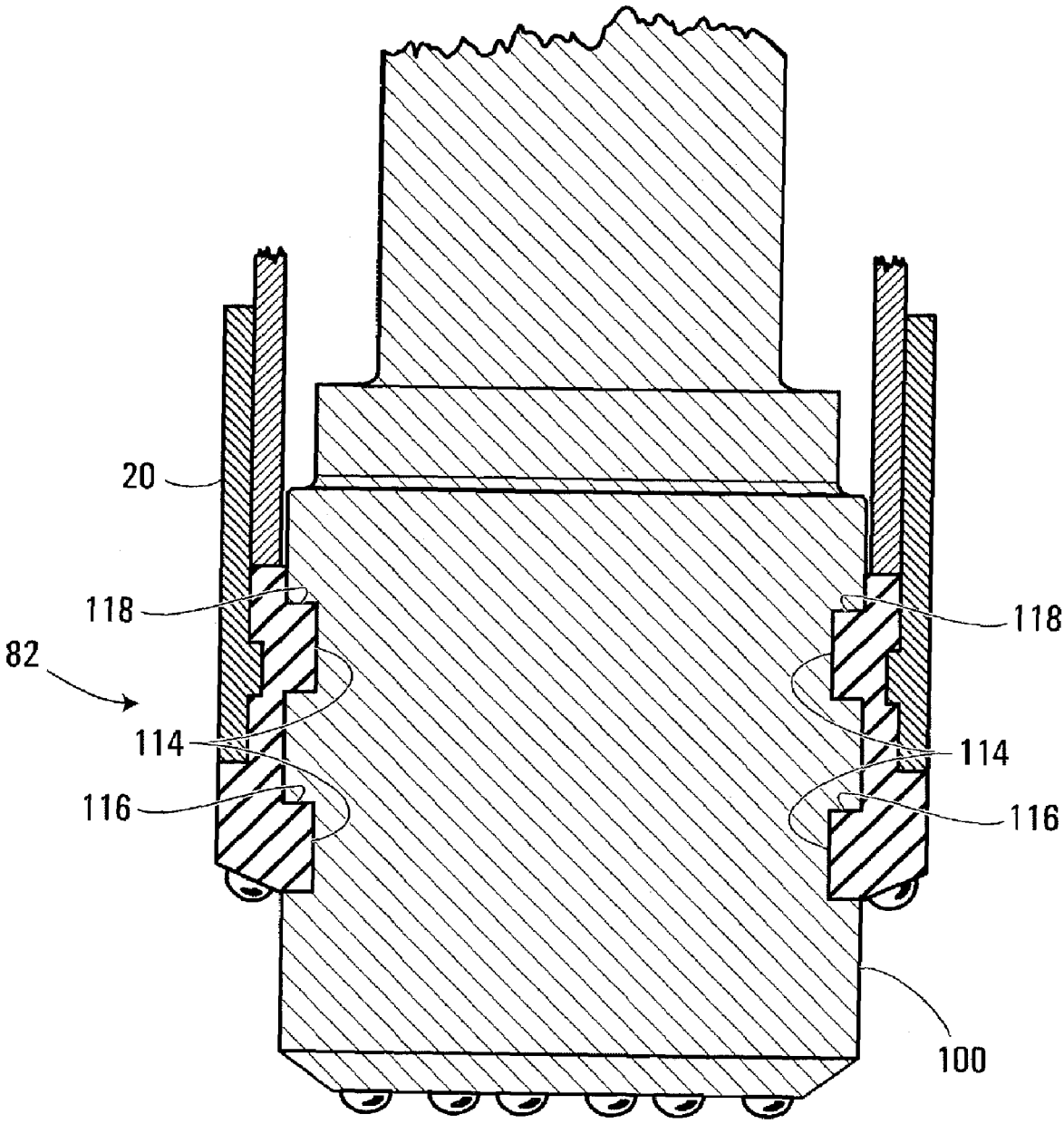
FIG. 16 shows a cross sectional view of the crown bit of FIG. 14 engaged with the driver drill bit of FIG. 15 in accordance with an alternative example of implementation of the present invention.

FIG. 16 shows the crown bit 82 and the driver drill bit 100 in locking engagement. As shown, the pair of locking surfaces 114 of each tapered cut-away portion 112 are adapted to engage with projections 90 and 92 of the crown bit 82. As mentioned above, when in locking engagement, the driver drill bit 100 is able to transmit force from the two surfaces 116 and 118 to the pair of projections 114 of the crown bit 82.

In a specific, non-limiting example of implementation a crown bit 10 having an outer diameter of 7.5 inches can be used with a casing 14 having an outer diameter of 6⅝ inches and an inner diameter of 6 inches. In addition, a square drill bit having a maximum diameter of 6 inches and a minimum diameter of 5½ inches may pass through the hollow passageway 28.

In a second specific, non-limiting example of implementation, a crown bit 10 having an outer diameter of 9.5 inches can be used with a casing 14 having an outer diameter of 8⅝ inches and an inner diameter of 8 inches. In addition a square drill bit having a maximum diameter of 8 inches and a minimum diameter of 7½ inches may pass through the hollow passageway 28.

Although various embodiments have been illustrated, this was for the purpose of describing, but not limiting, the invention. Various modifications will become apparent to those skilled in the art and are within the scope of this invention, which is defined more particularly by the attached claims.

The invention claimed is:

1. A crown bit suitable for use with a driver drill bit for overburden drilling, said crown bit comprising:

a) a tubular body having an inner surface and an outer surface, said inner surface being substantially cylindrical and defining a hollow passageway for receiving the drill bit, said hollow passageway being characterized by a maximum diameter and a minimum diameter;

b) a pair of projections extending into said hollow passageway for engaging the drill bit, each projection of said pair of projections being defined by a flat surface and an abutment surface, said projections being operative for locking the drill bit such that the drill bit is prevented from moving in either direction along a longitudinal axis of said crown bit, said projections being positioned on said inner surface according to a specific configuration whereby the total amount of contiguous inner surface area defining the maximum diameter of the hollow passageway is maximized.

2. A crown bit as defined in claim 1, wherein said projections divide said inner surface into discrete portions of contiguous inner surface area.

3. A crown bit as defined in claim 1, wherein said pair of projections define therebetween the minimum diameter.

4. A crown bit as defined in claim 1, wherein, under said specific configuration, said pair of projections are positioned opposite one another on said inner surface of said hollow passageway.

5. A driver drill bit suitable for use with a crown bit for overburden drilling, the crown bit including at least a two projections, said driver drill bit comprising:

a) a substantially cylindrical drilling head having a drilling face and a peripheral surface, said peripheral surface including:

i) a pair of cut-away portions positioned substantially opposite one another; and ii) a pair of locking surfaces, each locking surface being a flat surface that extends from a respective one of said cut-away portions of said drilling head and extends around a circumference of said drilling head such that rotation of said drilling head in relation to the crown bit causes the projections of the crown bit to move from said cut-way portions into engagement with said locking surfaces.

6. A driver drill bit as defined in claim 5, wherein said driver drill bit includes a shank portion connected to said drilling head.

7. A driver drill bit as defined in claim 6, wherein said shank is integrally formed with said drilling head.

8. A driver drill bit as defined in claim 7, wherein said drilling head further includes a pair of flushing passageways for debris to pass through.

9. A driver drill bit as defined in claim 8, wherein the diameter of said substantially cylindrical shape of said drilling head is a first diameter.

10. A driver drill bit as defined in claim 9, wherein the distance between said two-cut away portions defines therebetween a second diameter, said second diameter being less than said first diameter.

11. A driver drill bit as defined in claim 5, wherein said drilling face includes drilling organs.

12. A driver drill bit as defined in claim 5, wherein said locking surfaces have longitudinal axes that are parallel to a tangent of the peripheral surface of the drilling head.

13. A system suitable for overburden drilling, comprising:

a) a crown bit including:

i) a tubular body having an inner surface and an outer surface, said inner surface being substantially cylindrical and circumscribing a hollow passageway;

ii) a pair of projections extending into said hollow passageway, each projection of said pair of projections being defined by a flat surface, each of said projections being positioned substantially opposite one another on said inner surface;

b) a driver drill bit including:

i) a substantially cylindrical drilling head having a drilling face and a peripheral surface;

ii) a pair of cut-away portions positioned substantially opposite one another on said peripheral surface;

iii) a pair of locking surfaces, each locking surface being a flat surface that extends from a respective one of said cut-away portions of said drilling head and extends around a circumference of said drilling head such that rotation of said drilling head in relation to the crown bit causes the projections of the crown bit to move from said cut-way portions into engagement with said locking surfaces.

14. A system as defined in claim 13, wherein each locking surface extends substantially perpendicularly from a respective cut-away portion of said drilling head.

15. A system as defined in claim 14, wherein each projection of said pair of projections is adapted to abut a respective locking surface of said pair of locking surfaces such that said crown bit and said drill bit are in locking engagement.

16. A system as defined in claim 14, wherein said crown bit includes a ring bit and a driving shoe, said ring bit including said tubular body and said pair of projections.

17. A system as defined in claim 14, wherein said outer surface of said crown bit is substantially cylindrical in shape.

18. A system as defined in claim 17, wherein said hollow passageway is characterized by a maximum diameter.

19. A system as defined in claim 18, wherein said projections are positioned on said inner surface according to a specific configuration whereby the total amount of contiguous inner surface area defining the maximum diameter of the hollow passageway is maximized.

20. A system as defined in claim 19, wherein said pair of projections are characterized by a distance therebetween that defines a minimum diameter, said minimum diameter being greater than said maximum diameter.

21. A system as defined in claim 14, wherein said hollow passageway is a cylindrical hollow passageway.

22. A system as defined in claim 14, wherein said crown bit includes at most said two projections.

23. A system as defined in claim 14, wherein said crown bit further comprises a drilling end and a connection end, said drilling end including a drilling face having drilling organs and said connection end being adapted to be fixedly attached to a casing.

24. A system as defined in claim 14, wherein said drilling head of said driver drill bit further includes a pair of flushing passageways for debris to pass through.

25. A system as defined in claim 14, wherein said drilling face of said driver drill bit is characterized by a first diameter.

26. A system as defined in claim 25, wherein the distance between said two-cut away portions of said driver drill bit defines a second diameter, said second diameter being less than said first diameter.

27. A system suitable for sub-casing drilling comprising:

a) a crown bit including:

i) a driving shoe;

ii) a ring bit, said ring bit having an inner surface, an outer surface, and a pair of projections, each projection being defined by an abutment surface and a rotation imparting surface said rotation imparting surface being operative for receiving forces for imparting rotational movement to said ring bit and said abutment surface being operative for forces for imparting translational movement to said ring bit, said abutment surface and said rotation imparting surface sharing a common edge, said rotation imparting surfaces of said pair of projections being flat surfaces that are positioned opposite one another on said inner surface;

b) a square drill bit having a drilling head having two cut-away portions that correspond to said pair of projection of said crown bit, such that said square drill bit is adapted to pass through said hollow passageway of said crown bit.

28. A global drilling system comprising:

a) a crown bit having:

i) a tubular body having an inner surface and an outer surface, said inner surface circumscribing a hollow passageway;

ii) a pair of projections extending into said hollow passageway, said projections being positioned substantially opposite one another on said inner surface;

b) a driver drill bit having:

i) a substantially cylindrical drilling head having a drilling face and a peripheral surface, said peripheral surface including:

(1) a pair of cut-away portions positioned substantially opposite one another; and (2) a pair of locking surfaces, each locking surface being a flat surface that extends from a respective one of said cut-away portions of said drilling head and extends around a circumference of said drilling head such that rotation of said drilling head in relation to said crown bit causes said projections of said crown bit to move from said cut-way portions into engagement with said locking surfaces;

c) a square drill bit having:

i) a drilling head having a drilling face and a peripheral surface;

ii) two tapered cut-away portions positioned substantially opposite one another on said peripheral surface, each cut-away portion corresponding to one of said pair of projections such that said drilling head is able to pass through said hollow passageway of said crown bit.

* * * * *